United States Patent [19]

Gentile et al.

[11] Patent Number: 4,743,893

[45] Date of Patent: May 10, 1988

[54] EQUI CRANE ANTI-TIPPING DEVICE

[76] Inventors: Anthony Gentile, 3 Orleans Ct., Commack, N.Y. 11725; George Spector, 233 Broadway, Rm. 3615, New York, N.Y. 10007

[21] Appl. No.: 870,492

[22] Filed: Jun. 4, 1986

[51] Int. Cl.[4] ..... G08B 21/00

[52] U.S. Cl. ..... 340/685; 33/379; 340/689

[58] Field of Search ..... 340/685, 689; 33/379, 33/366, 365; 116/DIG. 13

[56] References Cited

U.S. PATENT DOCUMENTS

| | | | |
|---|---|---|---|
| 2,346,066 | 4/1944 | Conrad | 340/689 |
| 2,743,334 | 4/1956 | Valenti | 340/693 |
| 2,772,411 | 11/1956 | Cooper | 340/689 |
| 3,192,517 | 6/1965 | Werlin | 340/546 |
| 3,362,022 | 1/1968 | Mork et al. | 340/689 |
| 3,657,695 | 4/1972 | Birmingham | 340/689 |
| 3,848,750 | 11/1974 | Hoge | 340/685 |
| 4,408,196 | 10/1983 | Freeman | 340/690 |

*Primary Examiner*—Glen R. Swann, III

[57] ABSTRACT

A crane anti-tipping device is provided that includes a warning alarm unit in the cab of the crane which includes two spaced switches each of which is responsive to a predetermined tilting of the crane to close an electric circuit to activate the warning alarm unit that the crane is at a dangerous degree of tilt. A modification provides a sensing device incorporated with a stabilizing foot which will activate an alarm in the crane cab that the ground bearing pressure of the stabilizing foot exceeds a preset magnitude.

4 Claims, 1 Drawing Sheet

EQUI CRANE ANTI-TIPPING DEVICE

BACKGROUND OF THE INVENTION

The instant invention relates generally to indicators for cranes and more specifically it relates to a crane anti-tipping device.

Numerous indicators for cranes have been provided in prior art that are adapted to signal the crane operators through audible or visable signaling devices if the cranes are tilting due to excessive loads on the booms.

For example U.S. Pat. Nos. 2,346,066; 2,772,411 and 3,362,022 all are illustrative of such prior art.

While these units may be suitable for the particular purpose to which they address, they would not be as suitable for the purposes of the present invention as hereinbelow described because these devices and computations are inaccurate if the ground conditions change or the crane has left its level working plane. Moreover all warranties on cranes stress the level plane.

SUMMARY OF THE INVENTION

A primary object of the present invention is to provide a crane anti-tipping device that will overcome the shortcomings of the prior art devices.

Another object is to provide a crane anti-tipping device that is mounted within the cab of the crane which will warn the crane operator that the crane is not on a level plane and that tipping will occur if the crane makes an over capacity lift, or the ground or cribbing destabilzes while in the process of making the lift.

An additional object is to provide a crane anti-tipping device that is mounted within the stabilizer foot of the crane which will warn the crane operator that the crane is not on a level plane and that tipping will occur if the crane makes an over capacity lift or the ground gives way in the process of a lift.

A further object is to provide a crane anti-tipping device that is simple and easy to use.

A still further object is to provide a crane anti-tipping device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
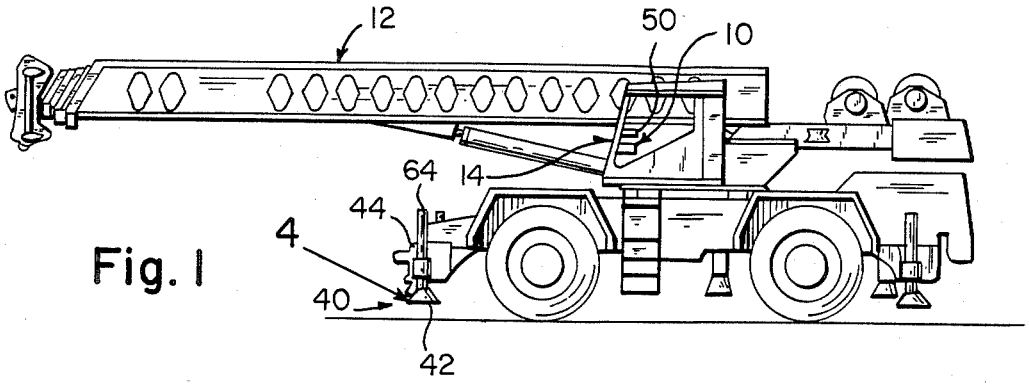
FIG. 1 is a side view of a crane with the invention installed within the cab.
Figure 2:
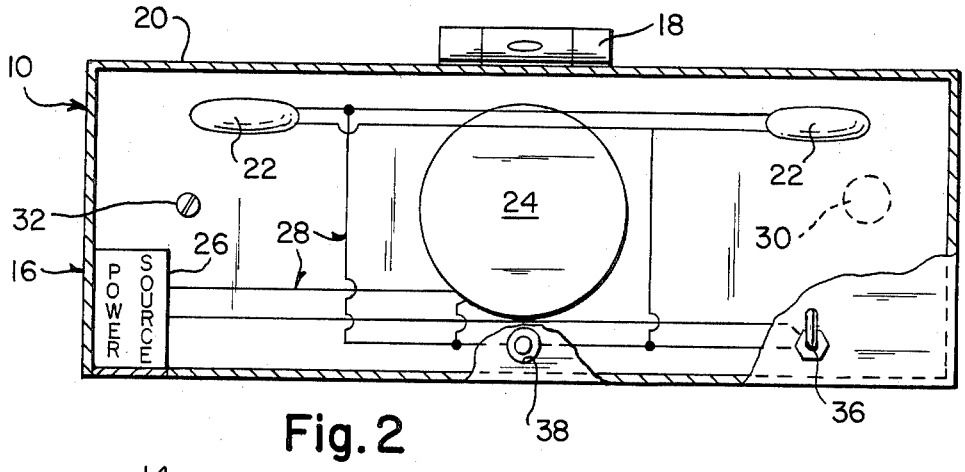
FIG. 2 is an enlarged front view of the device with parts broken away to show the electrical circuit inside the housing.
Figure 3:
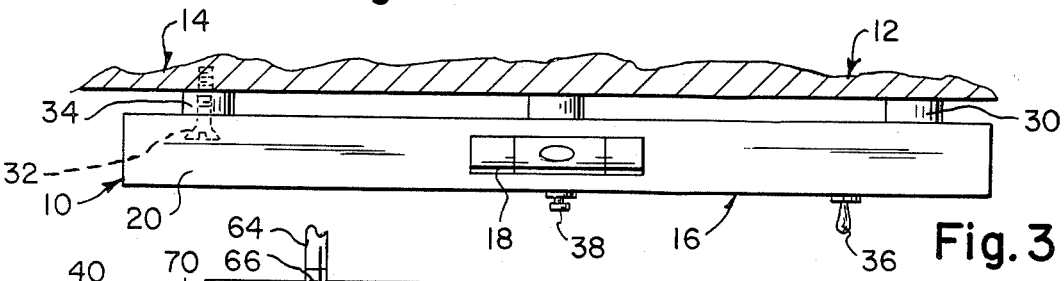
FIG. 3 is a top view thereof magnetically attached to the cab wall.

Turning now descriptively to the drawings, in which similar reference characters denote similar elements throughout the several views, FIGS. 1 through 3 illustrate a crane anti-tipping device 10 for a crane 12 that has a cab 14. The device 10 consists of a housing 16 attached to the cab 14 of the crane 12. A sight level bubble 18 is mounted to top 20 of the housing 16 to be viewed by operator (not shown) of the crane 12. A pair of normally open mercury tilt switches 22 are mounted within the housing 16. A warning alarm unit 24, which is a buzzer, is mounted within the housing 16.

Electrical leads from a power source 26, which can be a battery or the electrical system from the crane 12, extends in a circuit 28 to the tilt switches 22 and warning alarm unit 24. If the crane 12 is not level, one of the tilt switches 22 will close the circuit 28 activating the warning alarm unit 24 to warn the operator that the crane 12 is not on a level plane and that tipping will occur if the crane makes an over capacity lift or the ground gives way in the process of a lift.

Fasteners, such as magnets 30 can quickly attach the housing 16 to the cab 14. Other types of fasteners, such as bolts 32 with spacers 34 can permenantly attach the housing 16 to the cab 14.

An on-off power switch 36 is connected to the circuit 28 to turn the device 10 on and off when needed. A normally open test switch 38 is connected to the circuit 28 so that when the test switch 38 is manually pressed by the operator the buzzer 24 will sound.

Figure 4:
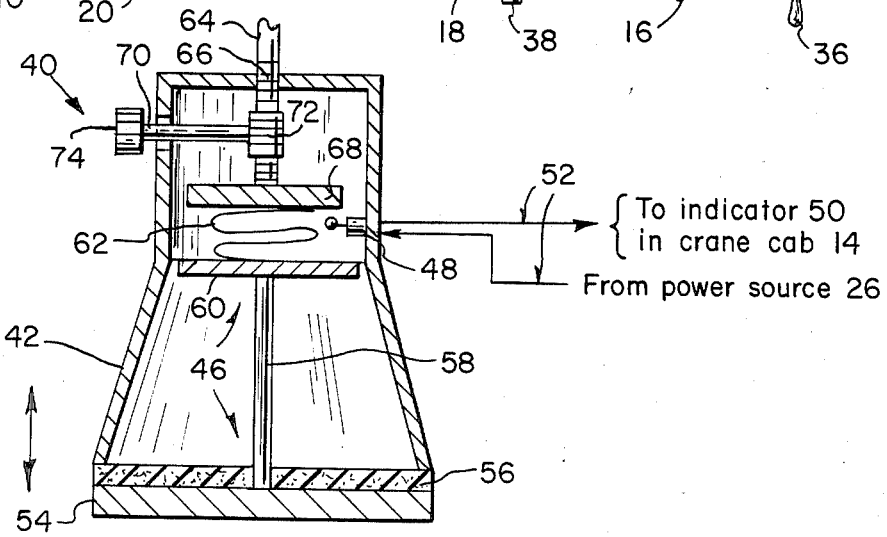
FIG. 4 is an enlarged cross sectional view of a modified stabilizer foot incorporating a device that can be adjusted to indicate and warn the operator that the ground bearing pressence is at a dangerous level.

FIGS. 1 and 4 shows another type of crane antitipping device 40 for the crane 12 that has a stabilizing foot 42 on a carrier frame 44. The device 40 consists of a scale mechanism assembly 46 mounted within the stabilizing foot 42. A sensor switch 48 mounted within the stabilizing foot 42 is activated by the scale mechanism assembly 46, when excess crane inclination increased pressure of foot 42 more than a preset magnitude. An indicator 50 is attached to the cab 14 of the crane 12. Electrical leads from the power source 26 extends in a circuit 52 to the sensor switch 48 and the indicator 50. If the crane 12 is inclined too much causing excess ground bearing pressure at foot 42 the scale mechanism assembly 46 will activate the sensor switch 48 closing the circuit 52 to operate the indicator 50 to warn the operator that the crane 12 is inclined too much causing excess ground bearing pressure at foot 42 and that tipping may occur or the ground may give way especially if the crane 12 makes an over capacity lift.

The scale mechanism 46 consists of a foot bearing plate 54 with a compression plate 56 sandwiched between the foot bearing plate and the stabilizing foot 42. A first vertical shaft 58 extends centrally upwardly from the foot bearing plate 54 and through the compression plate 56. A first shaft plate 60 is mounted transversely to distal end of the first shaft 58 while a compression spring 62 is placed upon the first shaft plate 60. A second vertical shaft 64 has a rack 66 thereon. The second shaft extends centrally downwardly from the carrier frame 44 while a second shaft plate 68 is mounted transversely to distal end of the second shaft 64. The second shaft plate 68 bears against the compression spring 62.

A horizontal adjustment shaft 70 extends through the stabilizing foot 42 and has a pinion gear 72 on inner end and a knob 74 on outer end. The pinion gear 72 is in engagement with the rack 66 on the second vertical shaft 64 so that the second shaft plate 68 can be adjusted to the compression spring 62 to properly activate the sensor switch 48 by means of assembly 46. Bearing pressure on plate 54 by the ground causes compression of plate 56 resulting in upward movement of shaft 58 and plate 60 to activate switch 48. Knob 74 is used to adjust the compression spring to predetermine the bearing pressure on the ground which will result in actuation of switch 48. For example the compression spring 62 can be preset whereby only bearing pressure above a preset maximum will cause sufficient compression in plate 56 to allow shaft 58 to travel upward to cause switch actuation. Thus when preset ground bearing pressure is exceeded the operator will be warned.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A crane anti-tipping device comprising a stabilizer foot in combination with adjustable means mounted in said foot responsive to ground bearing pressure to activate a sensor in said foot indicating excessive ground bearing pressure due to excessive crane inclination, wherein an indicator is provided in the crane cab electrically connected to said sensor.

2. A crane anti-tipping device as in claim 1, wherein said device comprise:

(a) an adjustable mechanism mounted in said stabilizing foot responsive to predetermined ground bearing pressure;

(b) a sensor switch mounted in said stabilizing foot activated by said mechanism when said pressure has exceeded a preset amount;

(c) an indicator mounted in said cab;

(d) electrical leads from a power source extending in a circuit to said sensor switch and said indicator, so that if said crane is excessively inclined said mechanism will activate said sensor switch closing said circuit to operate said indicator to warn the operator.

3. A device as in claim 2, wherein said mechanism includes a spring-compressing component whereby the spring pressure is adjustable.

4. A crane anti-tipping device as recited in claim 2, wherein said mechanism comprises:

(a) a foot bearing plate;

(b) a compression plate sandwiched between said foot bearing plate and said stabilizing foot, whereby ground bearing pressure causes compression of said compression plate and resultant axial upward movement of said bearing plate;

(c) a first vertical shaft extending axially from said foot bearing plate and through said compression plate;

(d) a first shaft plate mounted transversely on a distal end of said first shaft;

(e) a compression spring mounted on said first shaft plate;

(f) a second vertical shaft having a rack thereon, said second shaft extending centrally downwardly from said carrier frame;

(g) a second shaft plate mounted transversely to a distal end of said second shaft said second shaft plate bearing against said compression spring; and (h) a horizontal adjustment shaft extending through said stabilizing foot having a pinion gear on inner end and a knob on outer end, said pinion gear being in engagement with said rack on said second vertical shaft so that said second shaft plate can be adjusted to vary said compression spring pressure to allow activation of said sensor switch at preset ground bearing pressures of said stabilizing foot.

* * * * *